United States Patent [19]

Kulprathipanja

[11] Patent Number: 4,486,548

[45] **Date of Patent: * Dec. 4, 1984**

[54] ADSORBENT FOR THE EXTRACTION OF SUCROSE

[75] Inventor: Santi Kulprathipanja, Hoffman Estates, Ill.

[73] Assignee: UOP Inc., Des Plaines, Ill.

[ * ] Notice: The portion of the term of this patent subsequent to Feb. 3, 1998 has been disclaimed.

[21] Appl. No.: 530,337

[22] Filed: Sep. 8, 1983

Related U.S. Application Data

[60] Division of Ser. No. 306,262, Sep. 28, 1981, Pat. No. 4,405,378, which is a continuation-in-part of Ser. No. 235,063, Feb. 17, 1981, abandoned.

[51] Int. Cl.[3] ..... C13D 3/12

[52] U.S. Cl. ..... 502/404; 502/416

[58] Field of Search ..... 502/404, 416

[56] References Cited

U.S. PATENT DOCUMENTS 3,951,859 4/1976 Inaba et al. ..... 502/404 X 3,953,360 4/1976 Morishita et al. ..... 502/404 X 4,248,737 2/1981 Kulprathipanja ..... 502/62

4,295,994 10/1981 Kulprathipanja ..... 502/62

*Primary Examiner*—Patrick Garvin

*Attorney, Agent, or Firm*—James R. Hoatson, Jr.; Louis A. Morris; William H. Page, II

[57] ABSTRACT

An adsorbent suitable for use in separating sucrose from a solution with potassium chloride and betaine. The adsorbent comprises activated carbon bound with a binder material consisting essentially of a water permeable organic polymer from the group cellulose nitrate, a cellulose ester and/or a mixture thereof. Another aspect of the invention is a method of manufacturing the adsorbent comprising (a) mixing together a powder of activated carbon, a powder of binder and a liquid organic solvent to form a malleable mixture; (b) forming the malleable mixture into discrete formations; (c) removing the solvent from the formations to obtain hard dry formations; and (d) breaking the hard dry formations into particles of desired sizes.

9 Claims, 4 Drawing Figures

ADSORBENT FOR THE EXTRACTION OF SUCROSE

CROSS REFERENCE TO RELATED APPLICATION

This is a division of prior copending application Ser. No. 306,262, filed Sept. 28, 1981 and now U.S. Pat. No. 4,405,378, which is a continuation-in-part of application Ser. No. 235,063, filed Feb. 17, 1981, now abandoned, both prior references incorporated herein by reference. The first mentioned application issued Sept. 20, 1983, as U.S. Pat. No. 4,405,378.

BACKGROUND OF THE INVENTION

The field of art to which this invention pertains is solidbed adsorptive separation. More specifically, the invention relates to a new adsorbent, method of manufacture of the adsorbent and improved process for separating sucrose from an aqueous solution.

PRIOR ART

Sucrose, which is a common form of sugar, is widely used in the food industry. The usual source for this compound is found in the juice of sugar cane, sugar beets and other sucrose-containing materials. After the readily recoverable sucrose has been extracted from these sources, the mother liquors which are generally termed "molasses" will still contain a relatively large amount of sucrose along with other sugars such as glucose, fructose, raffinose, etc. The latter compounds along with salts, amino acids, betaine, pyrollidone, carboxylic acid, etc. constitute crystallization inhibitors which nake the recovery of the remaining sucrose difficult to accomplish and thus make the recovery of the sucrose no longer economically practical. In addition, the impurities which are present impart a taste to the molasses which renders the same inedible for human consumption.

Sugar beet molasses may contain approximately 50% sucrose and, therefore, it is highly desirable to extract this sucrose from the aforesaid molasses. Inasmuch as hereinbefore set forth, the molasses is bitter in human taste, the residual molasses is used in animal feed or as a fertilizer, and therefore a relatively low sucrose content is an acceptable feature of the molasses. At the present time there are only a few methods for extracting the sucrose present in molasses from the compounds of the type hereinbefore set forth. One such process which is utilized is the Steffan's process in which the beet molasses is diluted to about 20% solids, refrigerated, and treated with a calcium compound such as calcium oxide. This results in the reaction of the sucrose present with the calcium oxide to form tricalcium sucrate which is an insoluble granular precipitate. This precipitate can then be removed from the diluted molasses solution by filtration followed by washing, to remove adhering impurities. The tricalcium sucrate is returned to the beet processing operation by adding to the incoming hot beet juice. Under such conditions the tricalcium sucrate decomposes, releasing the sucrose to solution so that the calcium oxide has acted as a purification agent. However, a disadvantage which is inherent in the process is that certain impurities are recycled, particularly raffinose, which is a trihydrate material. With the continual recycling of the tricalcium sucrate the amount of raffinose present begins to accumulate and, as hereinbefore discussed, will retard the desired crystallization of the sucrose, thus making it necessary to discard a certain amount of circulating molasses from time to time.

In addition to the Steffan process it is also possible to separate sucrose by utilizing non-continuous chromatographic procedures which employ ion exchange resins to isolate sucrose from the molasses. However, neither of the procedures results in a complete separation of the sucrose even though high purity can be obtained. The processes which effect this separation employ a strong acid, polystyrene ion exchange resin in the alkaline or alkaline earth form and typically are as described by H. J. HONGISTO (Technical Department, Finnish Sugar Company Ltd., Kantvik, Finland), "Chromatographic Separation of Sugar Solutions; The Finsugar Molasses Desugarization Process"; paper presented to the 23rd Tech. Conf., British Sugar Comp. Ltd., 1976; and by Dr. MOHAMMAD MUNIR (Central Laboratory, Suddeutsche Zucker AG., 6719 Obrigheim 5, Wormser Str. 1, Germany), "Molasses Sugar Recovery by Liquid Distribution Chromatography"; the *International Sugar Journal,* 1976, 78, 100–106. A disadvantage which is present in the prior art processes lies in the fact that they require periodic back-flushing and regeneration of the ion exchange resin.

It has now been discovered that sucrose may be separated and recovered from mineral salts and/or betaine present in molasses by an adsorption-desorption technique utilizing, as the adsorbent therefor, activated carbon bound with a binder material comprising a water permeable organic polymer.

SUMMARY OF THE INVENTION

In brief summary, the present invention is, in one embodiment, an adsorbent suitable for use in separating sucrose from an aqueous solution of sucrose and at least one of the compounds comprising potassium chloride and betaine. The adsorbent comprises activated carbon bound with a binder material consisting essentially of a water permeable organic polymer from the group cellulose nitrate and/or a cellulose ester.

Other embodiments of my invention encompass details about a method for the manufacture of an adsorbent suitable for use in separating sucrose from an aqueous solution of sucrose and at least one of the compounds comprising potassium chloride and betaine, which method comprises: (a) mixing together a powder of said activated carbon, a powder of said binder and a liquid organic solvent to form a malleable mixture; (b) forming said malleable mixture into discrete formations; (c) removing said solvent from said formations to obtain hard dry formations; and (d) breaking said hard dry formations into particles of desired sizes.

DETAILED DESCRIPTION OF THE INVENTION

Figure 1:
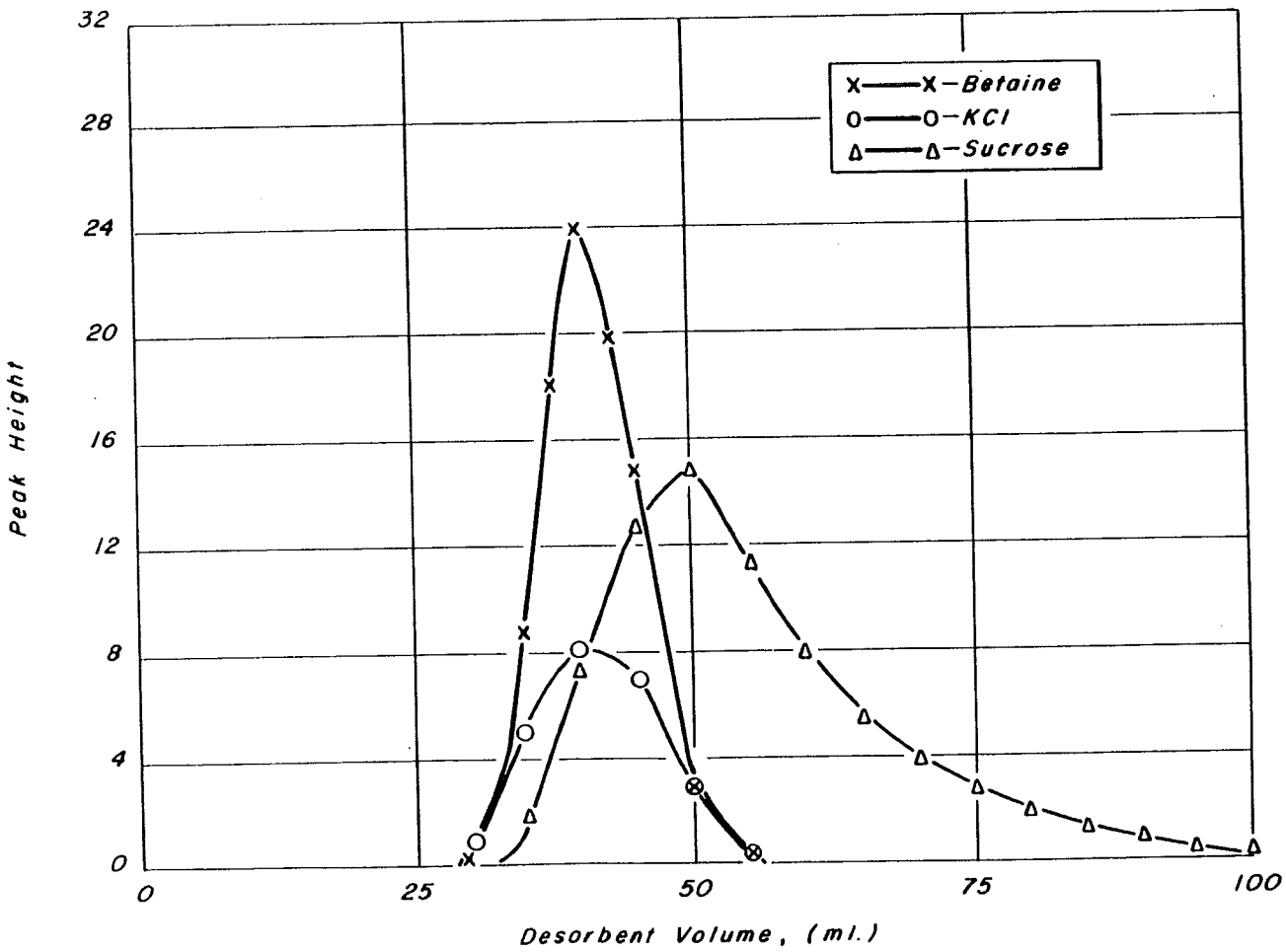

This invention relates to a process for separating sucrose from an aqueous solution of sucrose and at least one of the compounds comprising betaine and mineral salt. More specifically, the invention is concerned with a process for separating and recovering sucrose from a sugar source while still permitting the source such as molasses to be utilized in other fields such as for fertilizers or animal feed. The presence of other sugars which act as crystallization inhibitors make the recovery of sucrose in a process based on crystallization relatively difficult to accomplish. In this process the presence of another sugar, such as raffinose (comprising about 1 wt. % of a molasses having a sucrose content of 51 wt. %), presents no problem since the other sugar will be separated with the sucrose and the product stream will comprise the sugar mixture. Other components of molasses, such as the color imparting bodies, will also be separated with the sucrose. If desired, the raffinose may be removed from the feed or product streams by methods known to the art, such as enziomatic conversion which cleaves the tri-saccharide raffinose structure to the more desirable mono- and di-saccharides. The color bodies may be removed by high capacity activated carbon filters.

The process of the present invention is effected by passing a feed mixture containing sucrose and at least one of the components betaine and a mineral salt through an adsorbent of the type hereinafter set forth in greater detail. The passage of the feed stream over the adsorbent will result in the adsorption of sucrose while permitting the other above-mentioned components of the feed stream to pass through the treatment zone in an unchanged condition. Thereafter the sucrose (and other feed mixture components, if any, adsorbed with the sucrose) will be desorbed from the adsorbent by treating the adsorbent with a desorbent material. Preferred adsorption and desorption conditions include a temperature in the range of from about 20° C. to about 200° C. and a pressure in the range of from about atmospheric to about 500 psig to ensure a liquid phase.

For purposes of this invention the various terms which are hereinafter used may be defined in the following manner.

A feed mixture is a mixture containing one or more extract components and one or more raffinate components to be separated by the process. The term "feed stream" indicates a stream of a feed mixture which passes to the adsorbent used in the process.

An "extract component" is a compound or type of compound that is more selectively adsorbed by the adsorbent while a "raffinate component" is a compound or type of compound that is less selectively adsorbed. The term "desorbent material" shall mean generally a material capable of desorbing an extract component. The term "desorbent stream" or "desorbent input stream" indicates the stream through which desorbent material passes to the adsorbent. The term "raffinate stream" or "raffinate output stream" means a stream through which a raffinate component is removed from the adsorbent. The composition of the raffinate stream can vary from essentially 100% desorbent material to essentially 100% raffinate components. The term "extract stream" or "extract output stream" shall mean a stream through which an extract material which has been desorbed by a desorbent material is removed from the adsorbent. The composition of the extract stream, likewise, can vary from essentially 100% desorbent material to essentially 100% extract components. At least a portion of the extract stream and preferably at least a portion of the raffinate stream from the separation process are passed to separation means, typically fractionators, where at least a portion of desorbent material is separated to produce an extract product and a raffinate product. The terms "extract product" and "raffinate product" mean products produced by the process containing, respectively, an extract component and a raffinate component in higher concentrations than those found in the extract stream and the raffinate stream.

The adsorbents which are employed by this invention to selectively adsorb sucrose from betaine and mineral salts comprise activated carbon bound with a binder material comprising a water permeable organic polymer. An activated carbon found to be effective as an adsorbent in the present invention was acquired from Pittsburgh Activated Carbon, a division of Calgon Corporation, a subsidiary of Merck & Co., Inc., and is known as "Type PWA Pulverized Carbon". This activated carbon comprises high temperature steam activated bituminous coal. The Pittsburgh Activated Carbon sales literature for Type PWA Pulverized Carbon is incorporated herein by reference. The binder material in the adsorbent comprises a water permeable organic polymer. To be water permeable, the organic polymer, when a dry solid, will have throughout its mass small void spaces and channels which will allow an aqueous solution to penetrate the polymer and thereby come into contact with the activated carbon particles bound by the polymer. I have found cellulose nitrate and/or cellulose esters such as cellulose acetate to be particularly suitable for use in the adsorbent of this invention. The preferred concentration of the organic polymer in the adsorbent is from about 3.0 to about 50.0 wt. %.

The adsorbent of my invention is manufactured by mixing together powder of the activated carbon, powder of the water permeable organic polymer binder, and a liquid organic solvent to make the mixture malleable, forming the mixture into discrete formations, removing the solvent from the formations and breaking the formations into the desired size particles. The forming of the malleable mixture is preferably done by extrusion. The activated carbon and binder powders may first be mixed together and the solvent added to the powder mixture, or the binder powder may be first dissolved in the solvent and the activated carbon powder added to the solution. Preferred liquid organic solvents are p-dioxane, methyl-ethyl ketone, acetone, chloroform, benzyl alcohol, acetic acid, ethyl acetate and cyclohexanone, any of which may be mixed with formamide. The solvent is removed from the formations either by water washing followed by drying at about room temperature (20° C.), or by just drying at that temperature. The formations are broken into particles having a preferred size such that the particles will pass through a No. 30 screen and be retained on a No. 60 screen. Any fines resulting from the breaking of the particles not retained on a No. 60 screen may be added to the activated carbon-solvent-binder mixture.

The feed mixtures which are charged to the process of the present invention will comprise sugar sources, a specific source which is utilized in the present invention comprising molasses. Molasses is the mother liquor remaining from the juice of sugar cane or beet, i.e. "thick juice", after removal by crystallization of most of the sucrose therefrom. As hereinbefore discussed, rolasses such as cane molasses or sugar beet molasses will contain about 50% sucrose as well as other sugars such as glucose, fructose, raffinose as well as mineral salts and alkaloids, betaine, said other sugars and compounds being present in varying amounts. The most prevalent mineral salt in molasses is potassium chloride. The adsorbent of the present invention has been found to selectively adsorb sucrose while allowing certain other components in the sugar source, i.e. betaine and the mineral salts, to pass through the system unchanged. In addition, it has also been found that the initial capabilities of the adsorbent to selectively adsorb sucrose is maintained during the actual use in the separation process over an economically desirable life. In addition, as previously set forth, the adsorbent of this invention possesses the necessary adsorbent character in the ability of the adsorbent to separate components of the feed, that is that the adsorbent possesses adsorptive selectivity for one component as compared to other components. Relative selectivity can be expressed not only for one feed compound as compared to another but can also be expressed between any feed mixture component and the desorbent material. The selectivity, (B), as used throughout this specification is defined as the ratio of the two components of the adsorbed phase over the ratio of the same two components in the unadsorbed phase at equilibrium conditions. Relative selectivity is shown as Equation 1, below.

$$\text{Selectivity} = (B) = \frac{[\text{wt. percent } C/\text{wt. percent } D]_A}{[\text{wt. percent } C/\text{wt. percent } D]_U} \qquad \text{Equation 1}$$

where C and D are two components of the feed represented in weight percent and the subscripts A and U represent the adsorbed and unadsorbed phases respectively. The equilibrium conditions are determined when the feed passing over a bed of adsorbent does not change composition after contacting the bed of adsorbent. In other words, there is no net transfer of material occurring between the unadsorbed and adsorbed phases. Where selectivity of two components approaches 1.0 there is no preferential adsorption of one component by the adsorbent with respect to the other; they are both adsorbed (or non-adsorbed) to about the same degree with respect to each other. As the (B) becomes less than or greater than 1.0 there is a preferential adsorption by the adsorbent for one component with respect to the other. When comparing the selectivity by the adsorbent of one component C over component D, a (B) larger than 1.0 indicates preferential adsorption of component C within the adsorbent. A (B) less than 1.0 would indicate that component D is preferentially adsorbed leaving an unadsorbed phase richer in component C and an adsorbed phase richer in component D. Ideally desorbent materials should have a selectivity equal to about 1 or slightly less than 1 with respect to all extract components so that all of the extract components can be desorbed as a class with reasonable flow rates of desorbent material, and so that extract components can displace desorbent material in a subsequent adsorption step. While separation of an extract component from a raffinate component is theoretically possible when the selectivity of the adsorbent for the extract component with respect to the raffinate component is greater than 1, it is preferred that such selectivity approach a value of 2. Like relative volatility, the higher the selectivity the easier the separation is to perform. Higher selectivities permit a smaller amount of adsorbent to be used. The third important characteristic is the rate of exchange of the extract component of the feed mixture material or, in other words, the relative rate of desorption of the extract component. This characteristic relates directly to the amount of desorbent material that must be employed in the process to recover the extract component from the adsorbent; faster rates of exchange reduce the amount of desorbent material needed to remove the extract component and therefore permit a reduction in the operating cost of the process. With faster rates of exchange, less desorbent material has to be pumped through the process and separated from the extract stream for reuse in the process.

Desorbent materials used in various prior art adsorptive separation processes vary depending upon such factors as the type of operation employed. In the swing-bed system, in which the selectively adsorbed feed component is removed from the adsorbent by a purge stream, desorbent selection is not as critical and desorbent material comprising gaseous hydrocarbons such as methane, ethane, etc., or other types of gases such as nitrogen or hydrogen, may be used at elevated temperatures or reduced pressures or both to effectively purge the adsorbed feed component from the adsorbent. However, in adsorptive separation processes which are generally operated continuously at substantially constant pressures and temperatures to insure liquid phase, the desorbent material must be judiciously selected to satisfy many criteria. First, the desorbent material should displace an extract component from the adsorbent with reasonable mass flow rates without itself being so strongly adsorbed as to unduly prevent an extract component from displacing the desorbent material in a following adsorption cycle. Expressed in terms of the selectivity (hereinafter discussed in more detail), it is preferred that the adsorbent be more selective for all of the extract components with respect to a raffinate component than it is for the desorbent material with respect to a raffinate component. Secondly, desorbent materials must be compatible with the particular adsorbent and the particular feed mixture. More specifically, they must not reduce or destroy the critical selectivity of the adsorbent for an extract component with respect to a raffinate component. Additionally, desorbent materials should not chemically react with or cause a chemical reaction of either an extract component or a raffinate component. Both the extract stream and the raffinate stream are typically removed from the adsorbent in admixture with desorbent material and any chemical reaction involving a desorbent material and an extract component or a raffinate product or both. Since both the raffinate stream and the extract stream typically contain desorbent materials, desorbent materials should additionally be substances which are easily separable from the feed mixture that is passed into the process. Without a method of separating at least a portion of the desorbent material present in the extract stream and the raffinate stream, the concentration of an extract component in the extract product and the concentration of a raffinate component in the raffinate product would not be very high, nor would the desorbent material be available for reuse in the process. It is contemplated that at least a portion of the desorbent material will be separated from the extract and the raffinate streams by distillation or evaporation, but other separation methods such as reverse osmosis may also be employed alone or in combination with distillation or evaporation. Since the raffinate and extract products are foodstuffs intended for human consumption, desorbent materials should also be non-toxic. Finally, desorbent materials should also be materials which are readily available and therefore reasonable in cost. I have found that a water-methanol mixture satisfies these criteria, particularly when the methanol and water are mixed in a volume ratio of about 1.0:1.0.

A dynamic testing apparatus is employed to test various adsorbents with a particular feed mixture and desorbent material to measure the adsorbent characteristics of adsorptive capacity, selectivity and exchange rate.

The apparatus consists of an adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect quantitatively or determine qualitatively one or more components in the effluent stream leaving the adsorbent chamber. A pulse test, performed using this apparatus and the following general procedure, is used to determine selectivities and other data for various adsorbent systems. The adsorbent is filled to equilibrium with a particular desorbent material by passing the desorbent material through the adsorbent chamber. At a convenient time, a pulse of feed containing known concentrations of sucrose and of a particular crystallization inhibitor(s) all diluted in desorbent is injected for a duration of several minutes. Desorbent flow is resumed, and the sucrose and the crystallization inhibitors are eluted as in a liquid-solid chromatographic operation. The effluent can be analyzed on-stream or alternatively effluent samples can be collected periodically and later analyzed separately by analytical equipment and traces of the envelopes of corresponding component peaks developed.

From information derived from the test adsorbent performance can be rated in terms of void volume, retention volume for an extract or a raffinate component, selectivity for one component with respect to the other, and the rate of desorption of an extract component by the desorbent. The retention volume of an extract or a raffinate component may be characterized by the distance between the center of the peak envelope of an extract or a raffinate component and the peak envelope of the tracer component or some other known reference point. It is expressed in terms of the volume in cubic centimeters of desorbent pumped during this time interval represented by the distance between the peak envelopes. Selectivity, (B), for an extract component with respect to a raffinate component may be characterized by the ratio of the distance between the center of the extract component peak envelope and the tracer peak envelope (or other reference point) to the corresponding distance between the center of the raffinate component peak envelope and the tracer peak envelope. The rate of exchange of an extract component with the desorbent can generally be characterized by the width of the peak envelopes at half intensity. The narrower the peak width the faster the desorption rate. The desorption rate can also be characterized by the distance between the center of the tracer peak envelope and the disappearance of an extract component which has just been desorbed. This distance is again the volume of desorbent pumped during this time interval.

The adsorbent may be employed in the form of a dense compact fixed bed which is alternatively contacted with the feed mixture and desorbent materials. In the simplest embodiment of the invention the adsorbent is employed in the form of a single static bed in which case the process is only semi-continuous. In another embodiment a set of two or more static beds may be employed in fixed-bed contacting with appropriate valving so that the feed mixture is passed through one or more adsorbent beds while the desorbent materials can be passed through one or more of the other beds in the set. The flow of feed mixture and desorbent materials may be either up or down through the desorbent. Any of the conventional apparatus employed in static bed fluid-solid contacting may be used.

Countercurrent moving bed or simulated moving bed countercurrent flow systems, however, have a much greater separation efficiency than fixed adsorbent bed systems and are therefore preferred. In the moving bed or simulated moving bed processes the adsorption and desorption operations are continuously taking place which allows both continuous production of an extract and a raffinate stream and the continual use of feed and desorbent streams. One preferred embodiment of this process utilizes what is known in the art as the simulated moving bed countercurrent flow system. The operating principles and sequence of such a flow system are described in U.S. Pat. No. 2,985,589, incorporated herein. In such a system it is the progressive movement of multiple liquid access points down an adsorbent chamber that simulates the upward movement of adsorbent contained in the chamber. Only four of the access lines are active at any one time; the feed input stream, desorbent inlet stream, raffinate outlet stream, and extract outlet stream access lines. Coincident with this simulated upward movement of the solid adsorbent is the movement of the liquid occupying the void volume of the packed bed of adsorbent. So that countercurrent contact is maintained, a liquid flow down the adsorbent chamber may be provided by a pump. As an active liquid access point moves through a cycle, that is, from the top of the chamber to the bottom, the chamber circulation pump moves through different zones which require different flow rates. A programmed flow controller may be provided to set and regulate these flow rates.

The active liquid access points effectively divide the adsorbent chamber into separate zones, each of which has a different function. In this embodiment of my process it is generally necessary that three separate operational zones be present in order for the process to take place although in some instances an optional fourth zone may be used.

The adsorption zone, zone 1, is defined as the adsorbent located between the feed inlet stream and the raffinate outlet stream. In this zone, the feedstock contacts the adsorbent, an extract component is adsorbed, and a raffinate stream is withdrawn. Since the general flow through zone 1 is from the feed stream which passes into the zone to the raffinate stream which passes out of the zone, the flow in this zone is considered to be a downstream direction when proceeding from the feed inlet to the raffinate outlet streams.

Immediately upstream with respect to fluid flow in zone 1 is the purification zone, zone 2. The purification zone is defined as the adsorbent between the extract outlet stream and the feed inlet stream. The basic operations taking place in zone 2 are the displacement from the non-selective void volume of the adsorbent of any raffinate material carried into zone 2 by the shifting of adsorbent into this zone and the desorption of any raffinate material adsorbed within the selective pore volume of the adsorbent or adsorbed on the surfaces of the adsorbent particles. Purification is achieved by passing a portion of extract stream material leaving zone 3 into zone 2 at zone 2's upstream boundary, the extract outlet stream, to effect the displacement of raffinate material. The flow of material in zone 2 is in a downstream direction from the extract outlet stream to the feed inlet stream.

Immediately upstream of zone 2 with respect to the fluid flowing in zone 2 is the desorption zone or zone 3. The desorption zone is defined as the adsorbent between the desorbent inlet and the extract outlet stream. The function of the desorption zone is to allow a desorbent material which passes into this zone to displace the extract component which was adsorbed upon the adsorbent during a previous contact with feed in zone 1 in a prior cycle of operation. The flow of fluid in zone 3 is essentially in the same direction as that of zones 1 and 2.

In some instances an optional buffer zone, zone 4, may be utilized. This zone, defined as the adsorbent between the raffinate outlet stream and the desorbent inlet stream, if used, is located immediately upstream with respect to the fluid flow to zone 3. Zone 4 would be utilized to conserve the amount of desorbent utilized in the desorption step since a portion of the raffinate stream which is removed from zone 1 can be passed into zone 4 to displace desorbent material present in that zone out of that zone into the desorption zone. Zone 4 will contain enough adsorbent so that raffinate material present in the raffinate stream passing out of zone 1 and into zone 4 can be prevented from passing into zone 3 thereby contaminating extract stream removed from zone 3. In the instances in which the fourth operational zone is not utilized the raffinate stream passed from zone 1 to zone 4 must be carefully monitored in order that the flow directly from zone 1 to zone 3 can be stopped when there is an appreciable quantity of raffinate material present in the raffinate stream passing from zone 1 into zone 3 so that the extract outlet stream is not contaminated.

A cyclic advancement of the input and output streams through the fixed bed of adsorbent can be accomplished by utilizing a manifold system in which the valves in the manifold are operated in a sequential manner to effect the shifting of the input and output streams thereby allowing a flow of fluid with respect to solid adsorbent in a countercurrent manner. Another mode of operation which can effect the countercurrent flow of solid adsorbent with respect to fluid involves the use of a rotating disc valve in which the input and output streams are connected to the valve and the lines through which feed input, extract output, desorbent input and raffinate output streams are advanced in the same direction through the adsorbent bed. Both the manifold arrangement and disc valve are known in the art. Specifically rotary disc valves which can be utilized in this operation can be found in U.S. Pat. Nos. 3,040,777 and 3,422,848. Both of the aforementioned patents disclose a rotary type connection valve in which the suitable advancement of the various input and output streams from fixed sources can be achieved without difficulty.

In many instances, one operational zone will contain a much larger quantity of adsorbent than some other operational zone. For instance, in some operations the buffer zone can contain a minor amount of adsorbent as compared to the adsorbent required for the adsorption and purification zones. It can also be seen that in instances in which desorbent is used which can easily desorb extract material from the adsorbent that a relatively small amount of adsorbent will be needed in a desorption zone as compared to the adsorbent needed in the buffer zone or adsorption zone or purification zone or all of them. Since it is not required that the adsorbent be located in a single column, the use of multiple chambers or a series of columns is within the scope of the invention.

It is not necessary that all of the input or output streams be simultaneously used, and in fact, in many instances some of the streams can be shut off while others effect an input or output of material. The apparatus which can be utilized to effect the process of this invention can also contain a series of individual beds connected by connecting conduits upon which are placed input or output taps to which the various input or output streams can be attached and alternately and periodically shifted to effect continuous operation. In some instances, the connecting conduits can be connected to transfer taps which during the normal operations do not function as a conduit through which material passes into or out of the process.

It is contemplated that at least a portion of the extract output stream will pass into a separation means wherein at least a portion of the desorbent material can be separated to produce an extract product containing a reduced concentration of desorbent material. Preferably, but not necessary to the operation of the process, at least a portion of the raffinate output stream will also be passed to a separation means wherein at least a portion of the desorbent material can be separated to produce a desorbent stream which can be reused in the process and a raffinate product containing a reduced concentration of desorbent material. The separation means will typically be a fractionation column, the design and operation of which is well-known to the separation art.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor-phase operation. Adsorption conditions will include a temperature range of from about 20° C. to about 200° C., with about 20° C. to about 100° C. being more preferred and a pressure range of from about atmospheric to about 500 psig with from about atrospheric to about 250 psig being more preferred to insure liquid phase. Desorption conditions will include the same range of temperatures and pressures as used for adsorption conditions.

The size of the units which can utilize the process of this invention can vary anywhere from those of pilot plant scale (see for example our assignee's U.S. Pat. No. 3,706,812) to those of commercial scale and can range in flow rates from as little as a few cc an hour up to many thousands of gallons per hour.

The following examples are given to illustrate the process of this invention, however, it is to be understood that these examples are given merely for purposes of illustration, and that the present invention is not necessarily limited thereto.

EXAMPLE I

The purpose of this example is to illustrate the following method of manufacture of the adsorbent of my invention:

(1) 130 grams of Type PWA Pulverized Carbon previously described was mixed with 56 grams of an organic polymer comprising cellulose acetate powder.

(2) 220 ml of an organic solvent comprising methyl-ethyl ketone was added to the powder mixture slowly and with mulling to obtain an extrudable mixture.

(3) The extrudable mixture was extruded into an extrudate.

(4) The extrudate was dried at 20° C.

(5) The dried extrudate was granulated and screened so as to obtain particles sized from 30 to 60 mesh as the finished adsorbent. The apparent bulk density of this adsorbent was measured to be 0.512 gm/ml.

EXAMPLE II

The purpose of this example is to present the results of pulse tests obtained from the above described pulse test apparatus when using the adsorbent of this invention as prepared in Example I with various desorbent compositions and when using an adsorbent comprising unbound Type PWA Pulverized Carbon. Feed pulses were 10 ml each and comprised 10 wt. % KCl, 10 wt. % betaine, 30 wt. % sucrose and 50 wt. % water. The column was operated at 60° C.

FIG. 1 shows the results of a first test where the adsorbent of Example I was used with the most preferred desorbent mixture comprising methanol and water in a 1.0:1.0 volumetric ratio. As clearly shown in FIG. 1 an excellent separation of sucrose from the other components was achieved. The sucrose was eluted last, which is indicative of it being the extract component, and substantially free of contamination by the other components. Furthermore, just as important, the sucrose was easily desorbed from the adsorbent as indicated by the substantial completion of desorption by the time 100 ml of desorbent passed through the column. Another way of stating this last observation is that there were minimal sucrose tailings.

Figure 2:
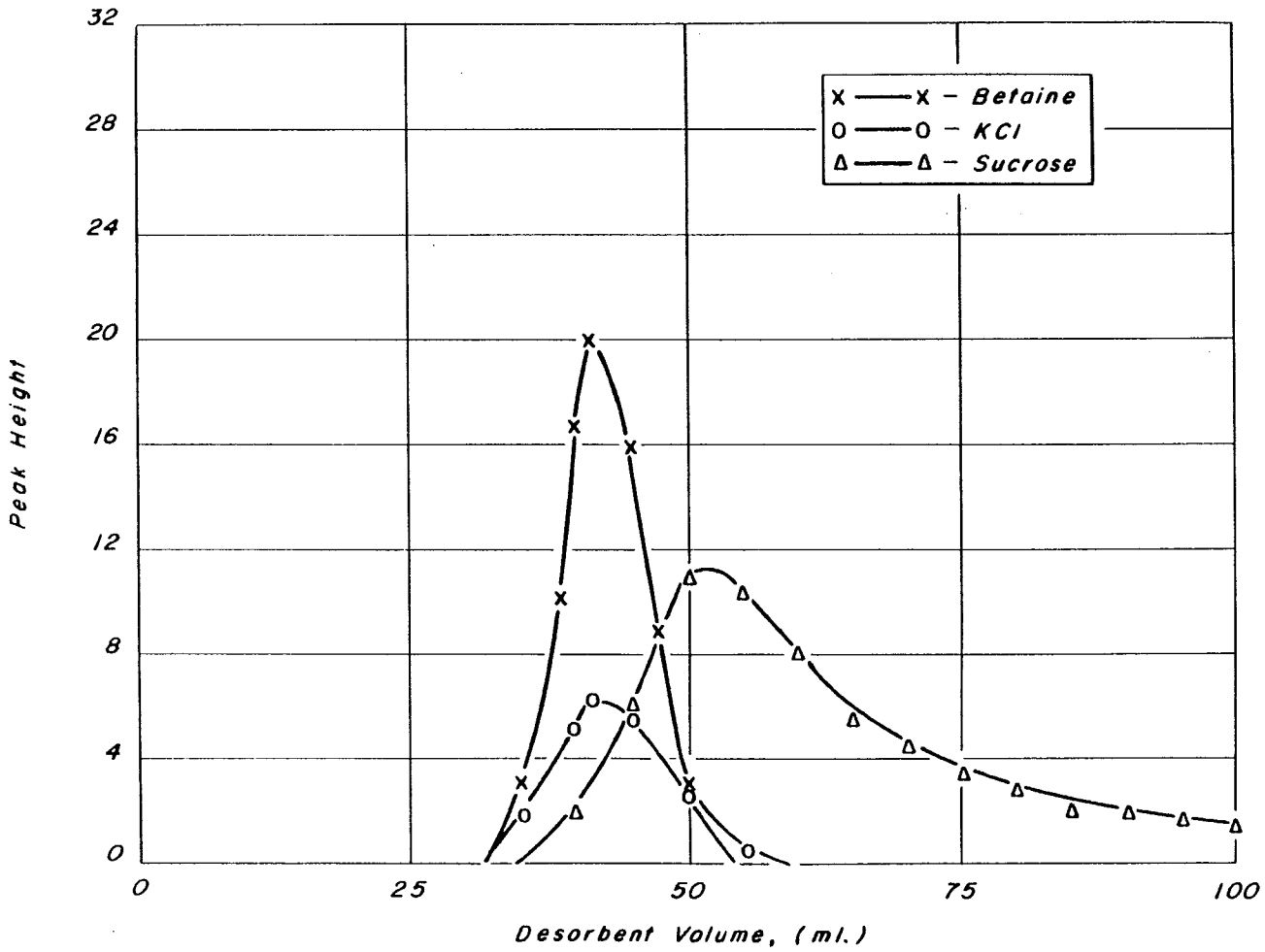

FIG. 2 shows the results of the second test which was in all respects conducted as the first test except that the desorbent comprised a methanol-water mixture in the volume ratio of methanol to water of 3.0:7.0. A good separation is shown in FIG. 2 except that there are noticeable tailings. It is clear, therefore, that the highest quality of separation is achieved with the methanol to water ratio of 1.0:1.0.

Figure 3:
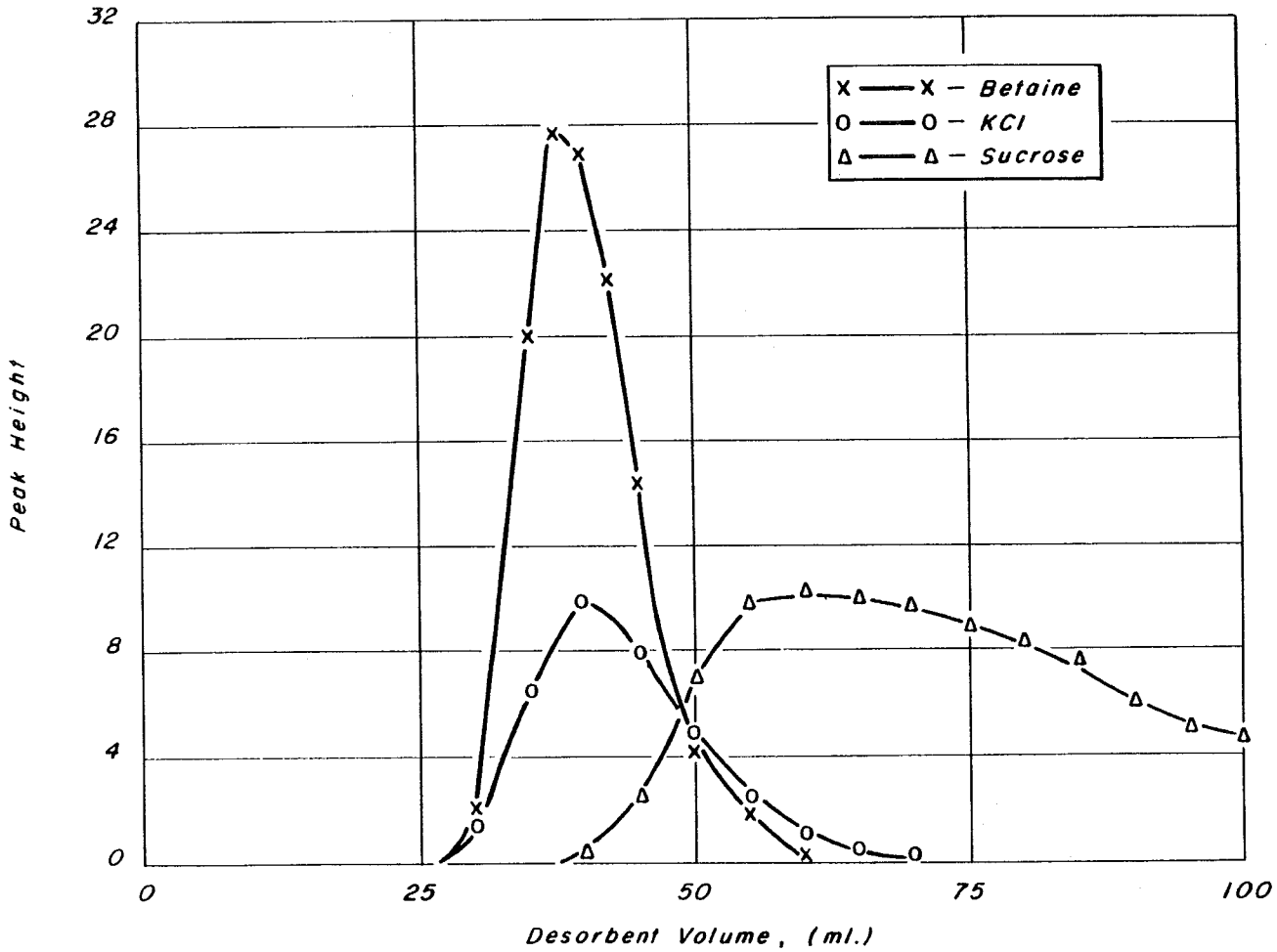

FIG. 3 shows the results of a third test which was in all respects conducted as the first test except that the adsorbent used was not the adsorbent of this invention, but simply comprised the aforementioned unbound Type PWA Pulverized Carbon. A relatively poor separation is shown in FIG. 3 in view of the significant tailings. The desorption properties of the adsorbent are thus clearly enhanced by the organic polymer binder and FIG. 3 illustrates the results of the absence of such binder.

Figure 4:
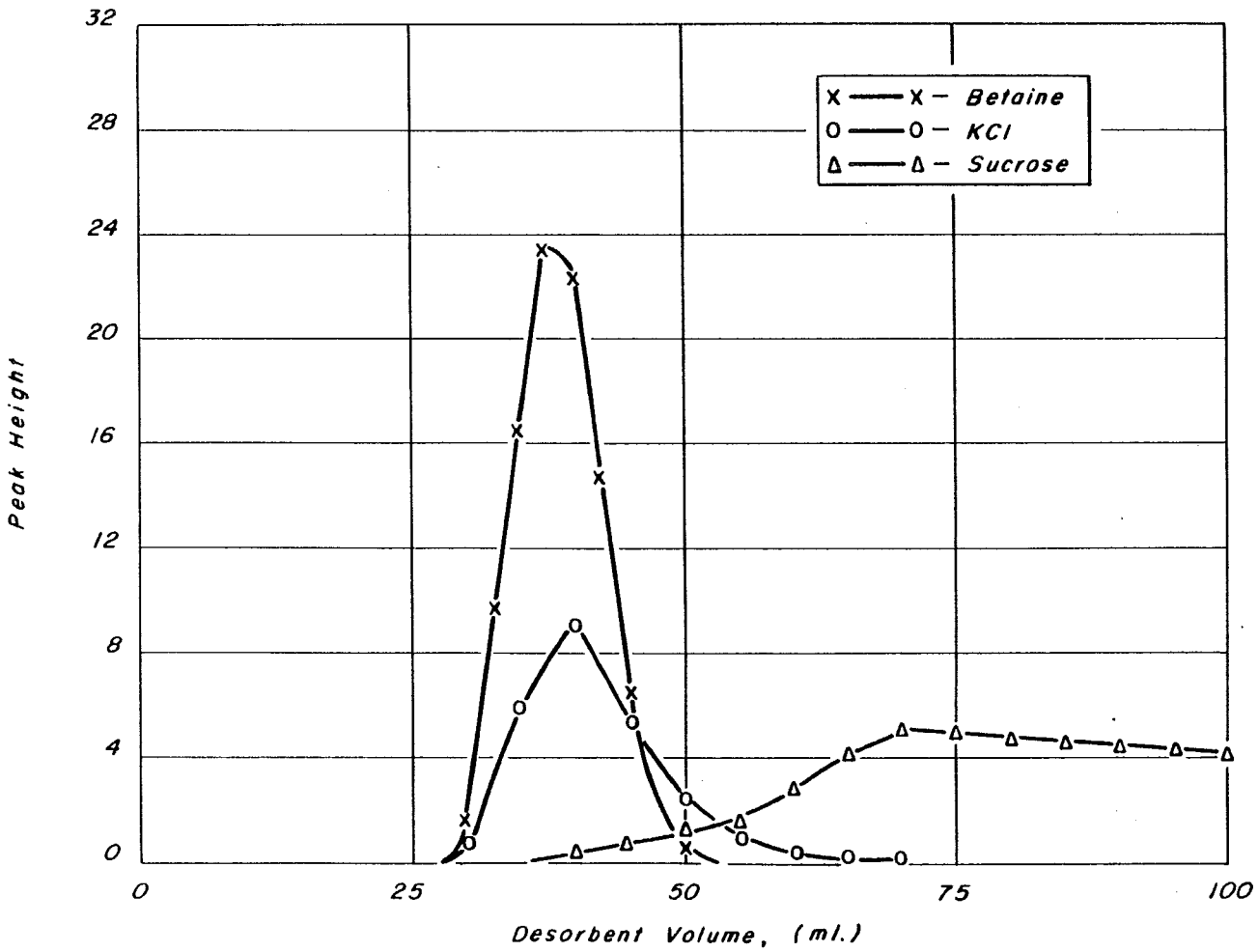

FIG. 4 shows the results of a fourth test which was in all respects conducted as the third test except that the desorbent comprised a methanol-water mixture in the volume ratio of methanol to water of 3.0:7.0. The quality, or lack thereof, of the separation achieved was about the same as for the third test.

In view of the foregoing tests the following conclusions are readily apparent:

(1) The activated carbon powder bound with the organic polymer comprising the adsorbent of the present invention achieves a separation superior to the unbound activated carbon.

(2) A 1.0:1.0 mixture of methanol and water is the preferred desorbent for use in the process of the present invention.

I claim as my invention:

1. A method for the manufacture of an adsorbent comprising activated carbon bound with a water permeable organic polymer binder comprising a cellulose ester or cellulose nitrate, said adsorbent suitable for use in separating sucrose from an aqueous solution of sucrose and at least one of the compounds comprising potassium chloride and betaine, which method comprises:

(a) mixing together a powder of said activated carbon, a powder of said binder and a liquid organic solvent to form a malleable mixture;

(b) forming said malleable mixture into discrete formations;

(c) removing said solvent from said formations to obtain hard dry formations; and (d) breaking said hard dry formations into particles of desired sizes.

2. The method of claim 1 further characterized in that in step (a) powders of said activated carbon and said binder are first mixed together to obtain a powder mixture, and said liquid organic solvent is then added to said powder mixture to obtain said malleable mixture.

3. The method of claim 1 further characterized in that in step (a) said powder of said binder is first dissolved in said organic solvent to obtain a solution, and said powder of said activated carbon is then added to said solution to obtain said malleable mixture.

4. The method of claim 1 further characterized in that in step (c) said solvent is removed from said formations by first washing said formations with water and then drying said formations at a temperature of about 20° C.

5. The method of claim 1 further characterized in that in step (c) said solvent is removed from said formations by drying said formations at a temperature of about 20° C.

6. The method of claim 1 further characterized in that in step (d) said desired sizes of said particles is such that said particles will pass through a No. 30 screen and be retained on a No. 60 screen.

7. The method of claim 1 further characterized in that the content of said organic polymer is said particles is from about 3.0 wt. % to about 50.0 wt. %.

8. The method of claim 1 further characterized in that said liquid organic solvent comprises p-dioxane, methyl-ethyl ketone, acetone, chloroform, benzylalcohol, cyclohexanone, acetic acid, or formamide.

9. The method of claim 1 further characterized in that in step (b) said forming is effected by extrusion.

* * * * *